US006339866B1

(12) United States Patent
French

(10) Patent No.: US 6,339,866 B1
(45) Date of Patent: Jan. 22, 2002

(54) METHOD AND APPARATUS FOR A REMOVABLE NAMETAG OR INSIGNIA

(76) Inventor: Vaughn French, 7959 S. Michigan Ave., Chicago, IL (US) 60619

( * ) Notice: Subject to any disclaimer, the term of this patent is extended or adjusted under 35 U.S.C. 154(b) by 0 days.

(21) Appl. No.: 09/535,109

(22) Filed: Mar. 24, 2000

Related U.S. Application Data

(63) Continuation-in-part of application No. 09/313,040, filed on May 17, 1999, now abandoned.

(51) Int. Cl.[7] ..... A44B 17/00

(52) U.S. Cl. ..... 24/306; 40/1.5; 40/594; 2/195.1; 24/3.1

(58) Field of Search ..... 24/306, 305, 304, 24/442, 3.1, 3.7, DIG. 11; 40/1.5, 1.6, 568, 594; 2/195.1, 69

(56) References Cited

U.S. PATENT DOCUMENTS

| | | | | | |
|---|---|---|---|---|---|
| 3,494,056 | A | * | 2/1970 | Elzer | 40/594 |
| 3,643,264 | A | | 2/1972 | Rector | 2/2.17 |
| 3,854,229 | A | * | 12/1974 | Morgan | 40/594 X |
| 4,104,816 | A | * | 8/1978 | Pingeton | 40/594 X |
| 4,480,399 | A | * | 11/1984 | Teti, Jr. | 40/594 X |
| 4,610,102 | A | | 9/1986 | Hill | 36/136 |
| 4,776,043 | A | | 10/1988 | Coleman | 2/199 |
| 4,873,726 | A | | 10/1989 | Tapia | 2/195.1 |
| 4,955,150 | A | | 9/1990 | Fagan | 36/136 |
| 4,961,275 | A | * | 10/1990 | Klein | 40/1.5 |
| 4,988,338 | A | | 1/1991 | Taylor et al. | 604/180 |
| 5,253,368 | A | | 10/1993 | Blake | 2/195.1 X |
| 5,276,985 | A | | 1/1994 | Halloran | 40/329 |
| 5,282,616 | A | * | 2/1994 | Stacavich-Notaro | 24/306 |
| 5,359,734 | A | | 11/1994 | Rathburn | 2/195.1 |
| 5,369,899 | A | | 12/1994 | Reeves | 40/1.5 |
| 5,454,120 | A | | 10/1995 | Rowlands | 2/195.1 |
| 5,632,047 | A | | 5/1997 | Van Den Heuvel | 2/209.13 |
| 5,697,618 | A | * | 12/1997 | Schlichting | 40/1.5 X |
| 5,718,589 | A | | 2/1998 | McCracken et al. | 2/49.1 X |
| 5,740,557 | A | | 4/1998 | Reid et al. | 2/195.1 X |
| 5,803,266 | A | | 9/1998 | Blackwelder | 206/575 |
| 5,813,153 | A | | 9/1998 | Maglio | 40/1.6 |
| 5,845,334 | A | * | 12/1998 | Marcolini, Jr. | 2/69 |

* cited by examiner

*Primary Examiner*—Robert J. Sandy
(74) *Attorney, Agent, or Firm*—Clifford Kraft

(57) ABSTRACT

A removable nametag or insignia that is placed on a uniform or garment with a hook-loop system like the product sold under the registered trademark VELCRO. A flexible backsheet is sewn or otherwise attached to the garment or uniform piece with a set of loops facing outward. A nametag or insignia, either rigid or flexible, is equipped with a set of hooks on its backside. The nametag or insignia is then pressed onto the backsheet when the member is to be worn. For laundering or other maintenance of the garment, the nametag or insignia is removed. Numerous garments can contain backsheets with loop material in the correct position. When the user wants to wear one of them, he or she simply presses the nametag or insignia into position. In this manner a single nametag or insignia can service a wardrobe of garments. The method allows nametags and insignia to be removably worn without making pin or postholes in garments.

10 Claims, 5 Drawing Sheets

METHOD AND APPARATUS FOR A REMOVABLE NAMETAG OR INSIGNIA

This is a Continuation-In-Part of application number 09/313,040, file May 17, 1999, now abandoned.

Field of the Invention

This invention relates generally to the field of nametags and insignia and more specifically to a removable nametag or insignia and a method of attaching it that can be used with any type of uniform, or in any situation where it is necessary to display a nametag or an insignia.

Description of Related Art

Numerous jobs require a person to wear a nametag; a few of them are policeman, fireman, waitress, clerk, etc. Also, some jobs require a person to wear various insignia of rank or organization, among them are the military where members may have to wear rank insignia on shoulders and possibly campaign ribbons over a breast pocket. Traditionally, all of these types of tags or insignia are placed on the uniform or garment with a pin or a set of pins or posts that pierce the garment. There are two major types of prior art pins: 1) a long stick pin with a clasp such as found on clerk and waitress nametags, and 2) a pair of direct posts with squeeze clips that penetrate straight into the garment with the squeeze clips pushed on from the back side. Police and military nametags and insignia are typically of the latter class.

Both types of pin devices are annoying to the user because of the amount of time required to put them on, and both types eventually destroy the material of the garment since they make holes in the material. Stress in wearing the device usually causes the holes to enlarge, and numerous removals and re-pinings when the garment is laundered make new holes and enlarge the old holes. Also, the clasp or squeeze clip pushes against the person's body sometimes causing rashes, red marks, and abrasions, or damaging undergarments. If a clasp comes open, or a squeeze clip works off, a person can actually be stuck by the pin causing a painful and possibly dangerous puncture wound. If the nametag or insignia accidentally receives a sharp blow, the clasp or squeeze clip can cause a painful welt. In addition, the clasp pin type of nametag is prone to come open and fall off, being lost without the wearer becoming aware of it. Also, such a clasp pin nametag is never straight vertical when it is worn, but rather tends to pivot about the pin causing the top to hang out and the bottom to slant inward. The hanging out top can get caught on things if the person tries to carry something or otherwise comes into contact with some other object. This can actually cause clothing to tear if the nametag is pinned on a shirt or blouse.

What is badly needed is a removable nametag or insignia that can be put on and taken off a shirt or uniform numerous times without damage to the garment (without making holes). This invention should contain no pins and should not protrude into the garment, thereby eliminating the possibility of wounds or bulges and of making any holes in the garment. The product should be strong and resistant to the tag or insignia pulling off or falling off.

SUMMARY OF THE INVENTION

The present invention relates to a nametag or insignia, usually, but not always rigid, that is attachable and detachable to a uniform shirt, dress, or other clothing. The tag or insignia can be constructed to have a panel of soft hook material on its back while the uniform or clothing can have a patch of felt-like or loop material sewed, or otherwise attached, in the position where the tag or insignia will be worn. The preferred hook and loop material system is sold under the registered trademark of VELCRO (VELCRO is a registered trademark of Velcro Corporation of America). Optionally, the present invention can use adhesive strips or any other means of attaching and detaching the tag or insignia to a uniform or clothing other than hooks and loops. Of course, the hook and loop parts of the system can be interchanged without affecting the operation of the present invention (the loops can be on the tag with the hooks on the garment).

In one embodiment of the present invention, a rigid nametag or insignia (for example military officer rank bars) can be made or converted to have no pins (it can be manufactured this way, or the pins on an existing device can be removed). A piece of hook (or loop) material can be glued, or otherwise attached, onto the nametag or insignia so that it is approximately the same size as the tag or just slightly smaller. The invention can be supplied with an adhesive surface opposed to the hook surface on this part. The adhesive surface can be covered with a peel-off protector for field use. The loop surface can be supplied to be either adhesively attached, iron-on adhesively attached, or sewed on to the uniform or garment, the preferred method is sewing. From then on, the nametag or insignia can be put on or taken off anytime desired simply by pushing the hook and loop parts together or pulling them apart. The present invention can also be supplied with only the tag hook materials so that different nametags or different insignia can be equipped to be put onto a garment with an existing loop patch. This way, people who need to change nametags or insignia can do so with no further modification to the uniform or garment. This is especially useful for people who might wear the same garment to more than one job in a day with the need to wear a different nametag or insignia on different jobs.

DESCRIPTION OF THE INVENTION

Figure 1:
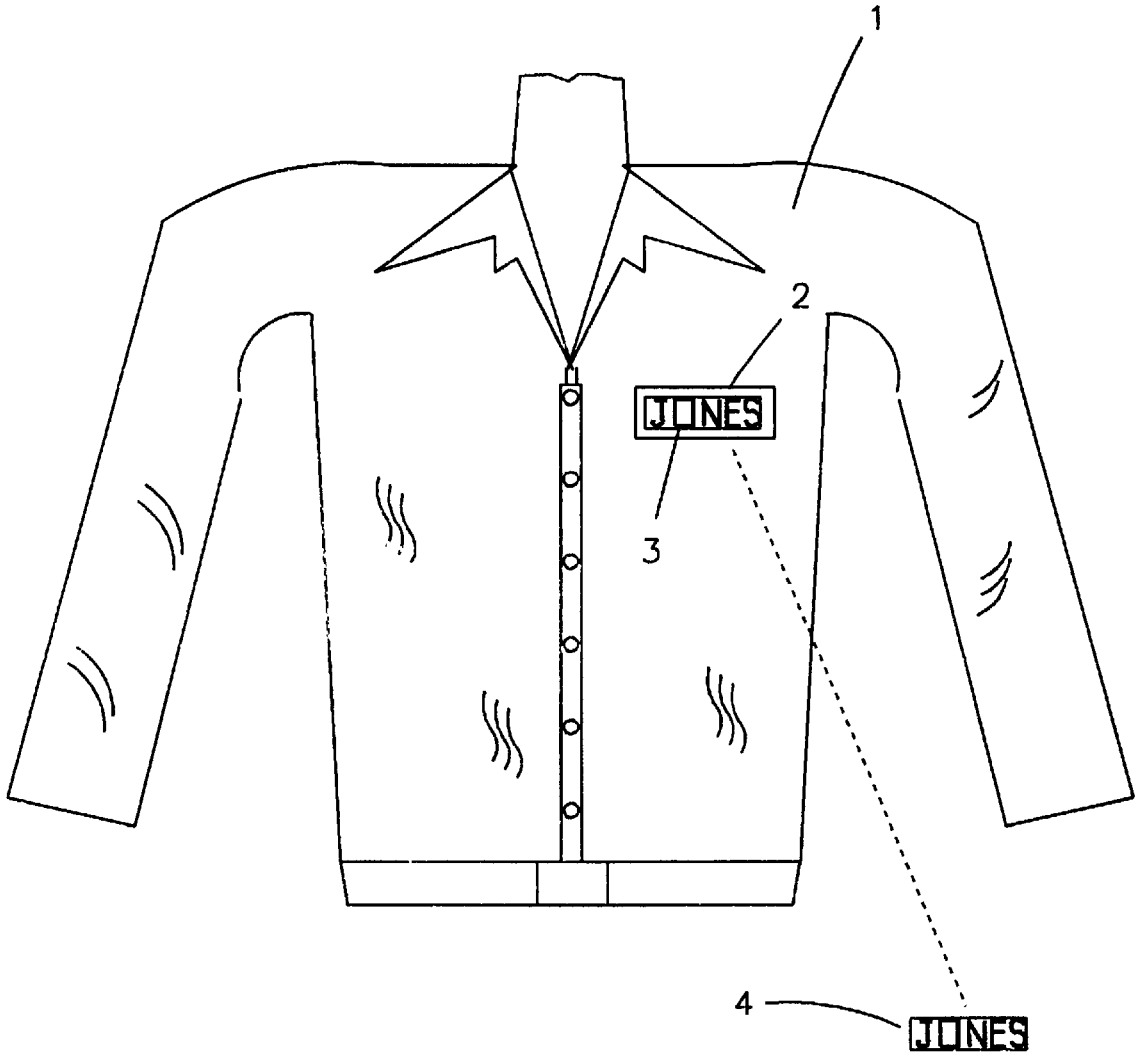
FIG. 1 shows a view of a method of using the present invention by using it to wear a nametag.

Turning to FIG. 1, the method and apparatus of the present invention is clearly shown as it relates to a nametag. A garment 1, in this example a shirt, can have a flexible sheetlike patch 2 attached either by sewing, with adhesive, with iron-on type adhesive, or by any other means of attaching a patch to a garment. Sewing is the preferred method of attaching. It should be noted that although in FIG. 1 a shirt is shown, the garment does not need to be a shirt, but can be any piece of clothing including a jacket, coat, blouse, dress, or other garment. The sheetlike patch or material can be cloth, synthetic, thin plastic, or any other suitable material.

A rigid planar insignia or nametag 3 (in FIG. 1 a nametag is shown) is pressed into position on the flexible sheet 3. The flexible sheet contains on its exposed surface a patch of loops of which a preferred material is sold under the registered trademark of VELCRO. The rigid planar piece, or tag, has attached to its backside a patch of hooks of which the preferred material again is VELCRO. FIG. 1 shows the method of using the present invention with a nametag. When the nametag 3 must be worn, it is pressed onto the correct position on the garment and remains there while the garment is worn. When the garment is to be laundered, ironed, or otherwise serviced, the nametag 4 is removed by pulling it off (separating the hook patch from the loop patch). By attaching flexible sheets with loop material on them to various shirts, jackets, etc., a single nametag can service a complete wardrobe of garments. Thus, one feature of the present invention is to supply numerous flexible back-sheet members for use with the same insignia or nametag without making any holes in any garment. Thus the present invention also includes a method of displaying insignia or names which causes no holes to be made in a garment.

The nametag can contain the identity of the wearer, or any other information such as unit, rank, or organization. The name can be put on the nametag with ink or it can be engraved or put on by any other means that makes it visible to one seeing it. The nametag can be metal, wood, plastic, or any other rigid or flexibly rigid material.

Figure 2:
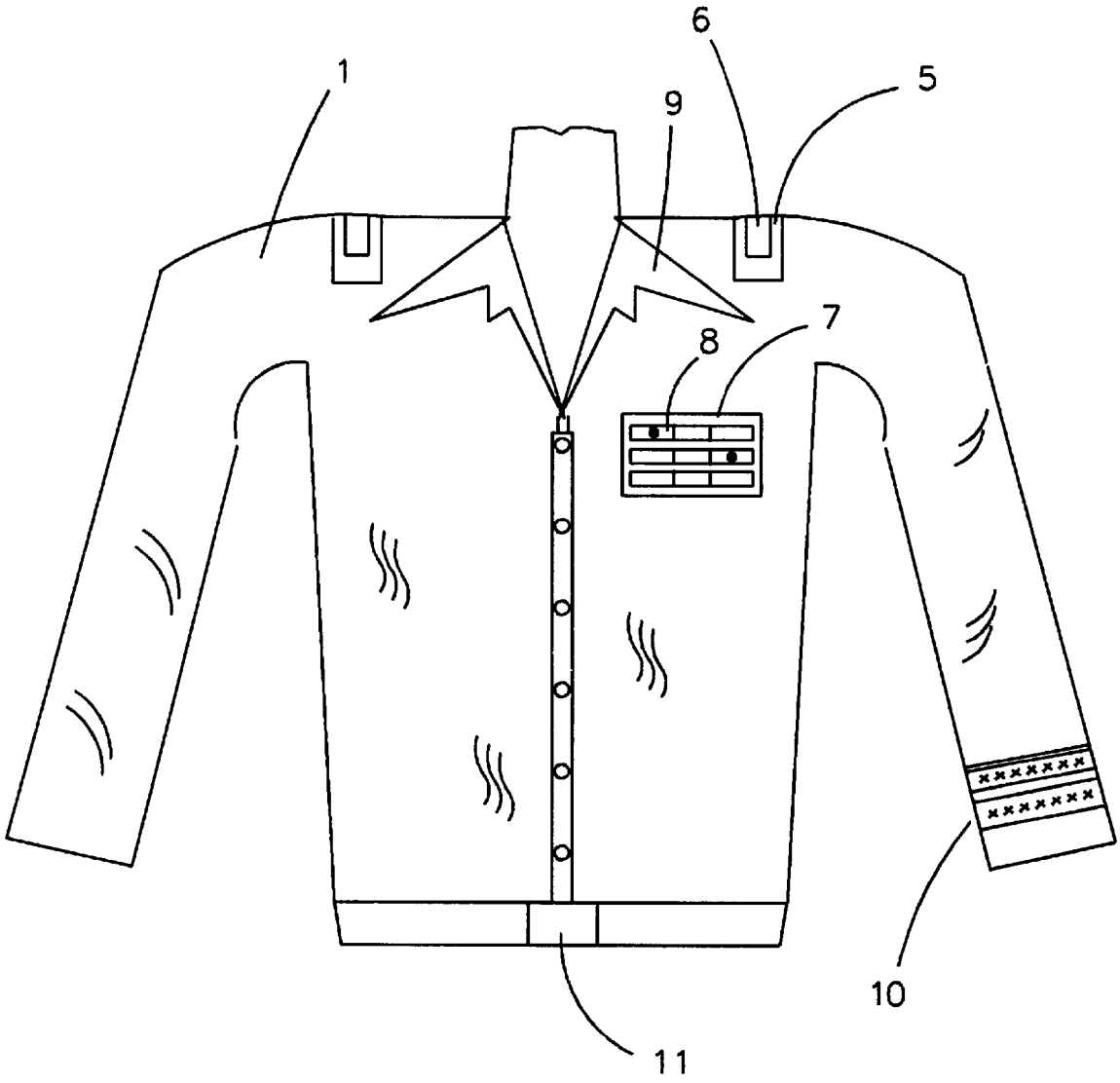
FIG. 2 shows a view of a method of using the present invention by using it to wear a military insignia.

FIG. 2 shows the present invention being used to display insignia of rank or medals on a military uniform shirt or coat 1. A backsheet, which can be cloth, synthetic, plastic, or other flexible or semi-flexible material, 5 can be sewn or mounted on shoulders for shoulder rank bars 6, on near a chest or breast pocket 7 for displaying medals 8, or on a sleeve 10 for rank stripes. It should be noted that a sleeve rank 10 can appear anywhere on the sleeve, not just in the position shown in FIG. 2. In this case, it may be of flexible material rather than rigid. In order for the uniform to maintain the correct appearance, the flexible sheetlike members 5, 7 can be made of a color to match the color of the uniform member, ie. blue, brown, olive-drab, etc., or any uniform color.

Figure 3:
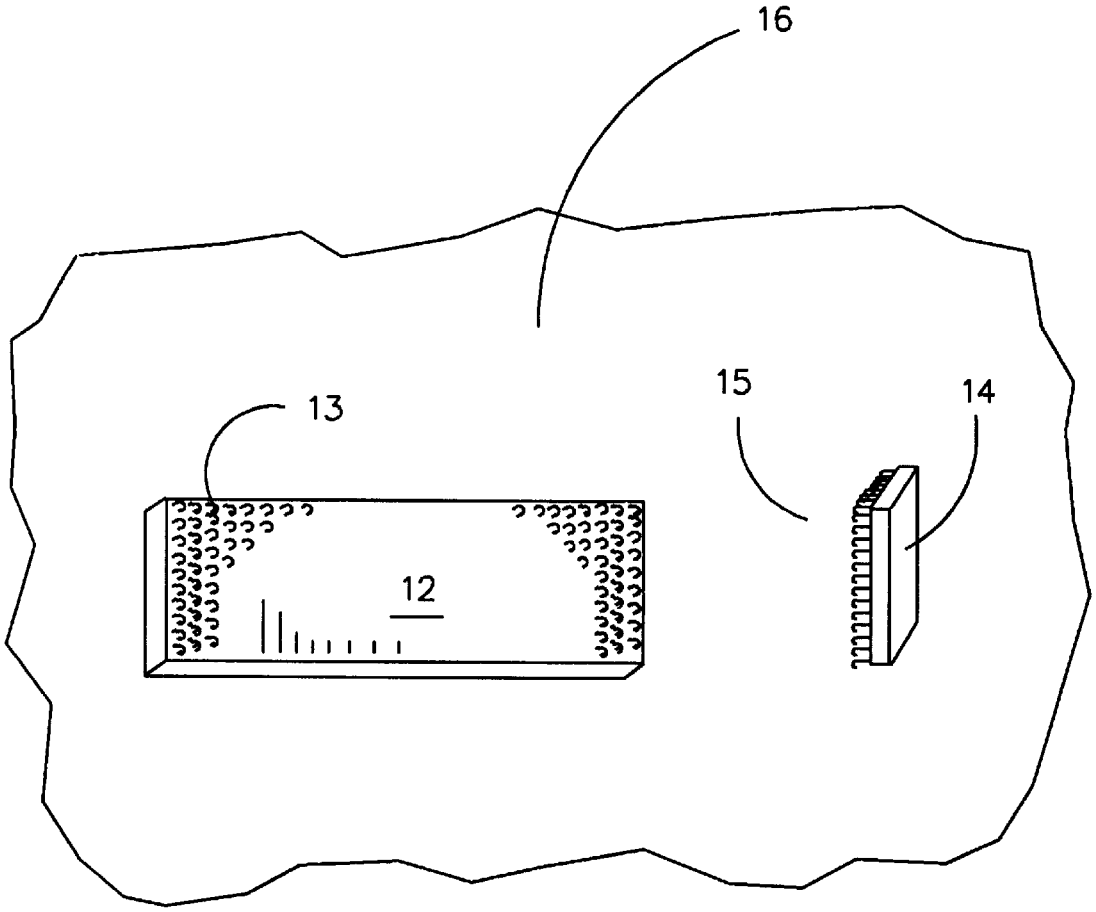
FIG. 3 shows an embodiment of the present invention where hooks are attached to a nametag or insignia and a mating loop surface is attached to a uniform or garment.

Turning to FIG. 3, the structure of one embodiment of the present invention can be seen. A flexible, sheetlike member 12 which can be cloth, synthetic, thin plastic, or any other flexible or semi-flexible material, is equipped with a patch of loops 13 similar to such patches sold under the registered trademark VELCRO with that product type being the preferred means. This sheetlike member, or back-sheet, can be sewed onto the garment 16 or attached in any other manner so that it cannot move or come loose. It can be attached with adhesive, iron-on adhesive, or by any other attachment means in addition to sewing. A rigid planar member 14 can be equipped with a patch of hooks 15 similar to such patches sold under the registered trademark VELCRO with that product type being the preferred means. The hook patch 15 can be attached to the rigid planar member 14 by adhesive or by any other attachment means.

Figure 4:
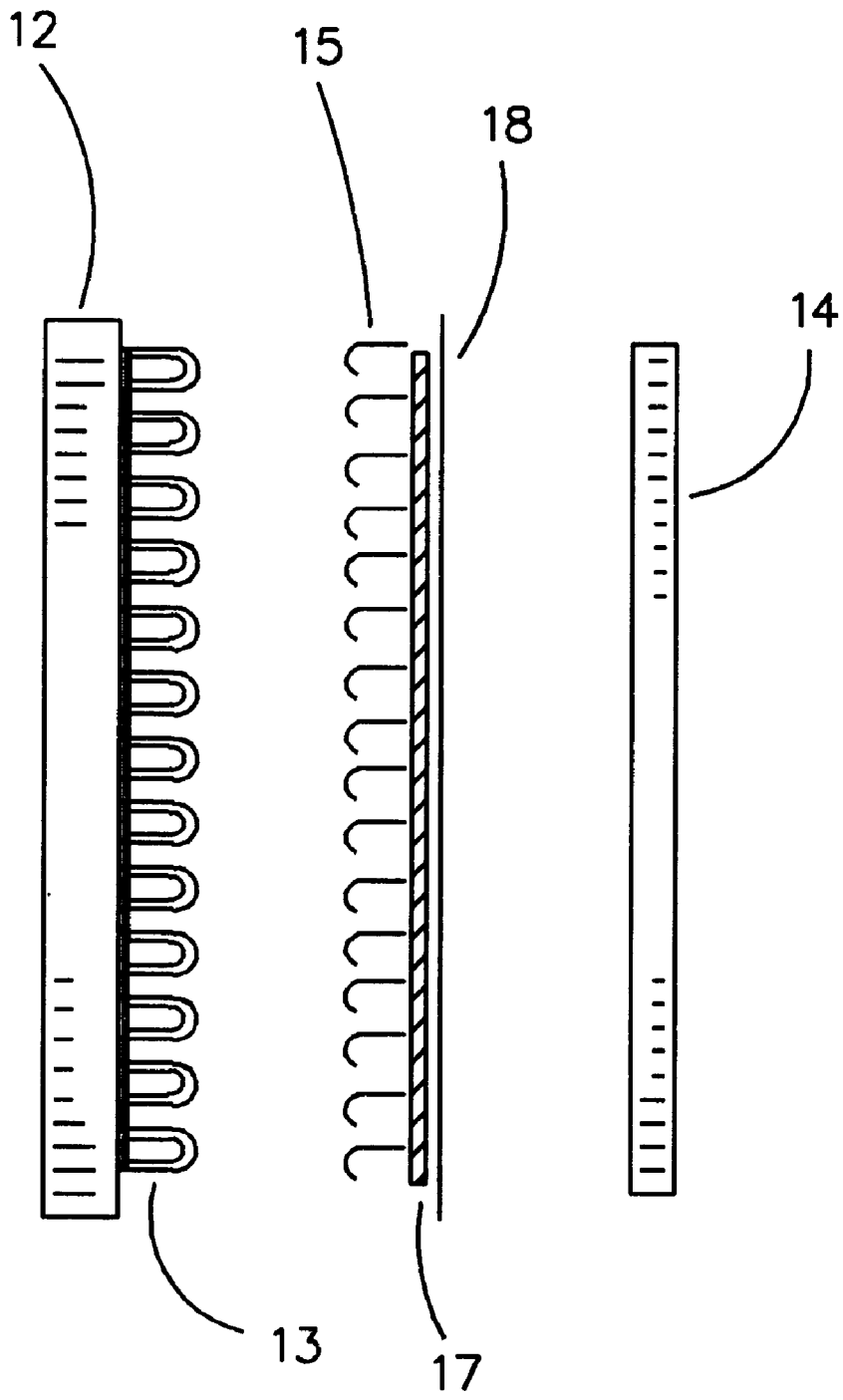
FIG. 4 shows an embodiment of the present invention where an adhesive is used to attach a hook patch to a nametag.

FIG. 4 shows an embodiment of the present invention where a flexible sheetlike member 12 is equipped with a patch of loops 13, and a nametag or insignia 14 is to be made attachable to the back-sheet 12. The flexible sheetlike member 12 can be non-woven synthetic resin material, cloth, or any other material that is flexible which can hold loops or hooks. A patch of hook material 15 can be coated on its non-active or flat side with a thin layer of adhesive 17. This layer 17 can be protected with a thin peel-off cover 18 before it is used. When it is desired to put the hook patch on a nametag or insignia, the protective cover 18 can be peeled off to expose the adhesive layer 17. The hook patch can then be pressed onto the nametag or insignia. The preferred material for the protective cover 18 is thin MYLAR (MYLAR is a registered trademark of DuPont Corp.). The preferred adhesive is any adhesive that will permanently dry after being pressed on the nametag or insignia. It should be noted that it is not necessary to the functioning of the invention that the hook patch be equipped with adhesive; this is an optional feature. It is entirely within the scope of both the method and apparatus of the present invention to supply the hook patch without adhesive and to apply the adhesive with a brush or in any other manner, or to supply the adhesive as a separate layer with or without a protective coat or cover. Any means of attaching the hook material to the planar member is within the scope of the present invention. Any means of attaching the loop material to the flexible back-sheet and any means of attaching the back-sheet to the garment is also within the scope of the present invention. The present invention also includes the option of directly attaching the loops to the garment.

Figure 5:
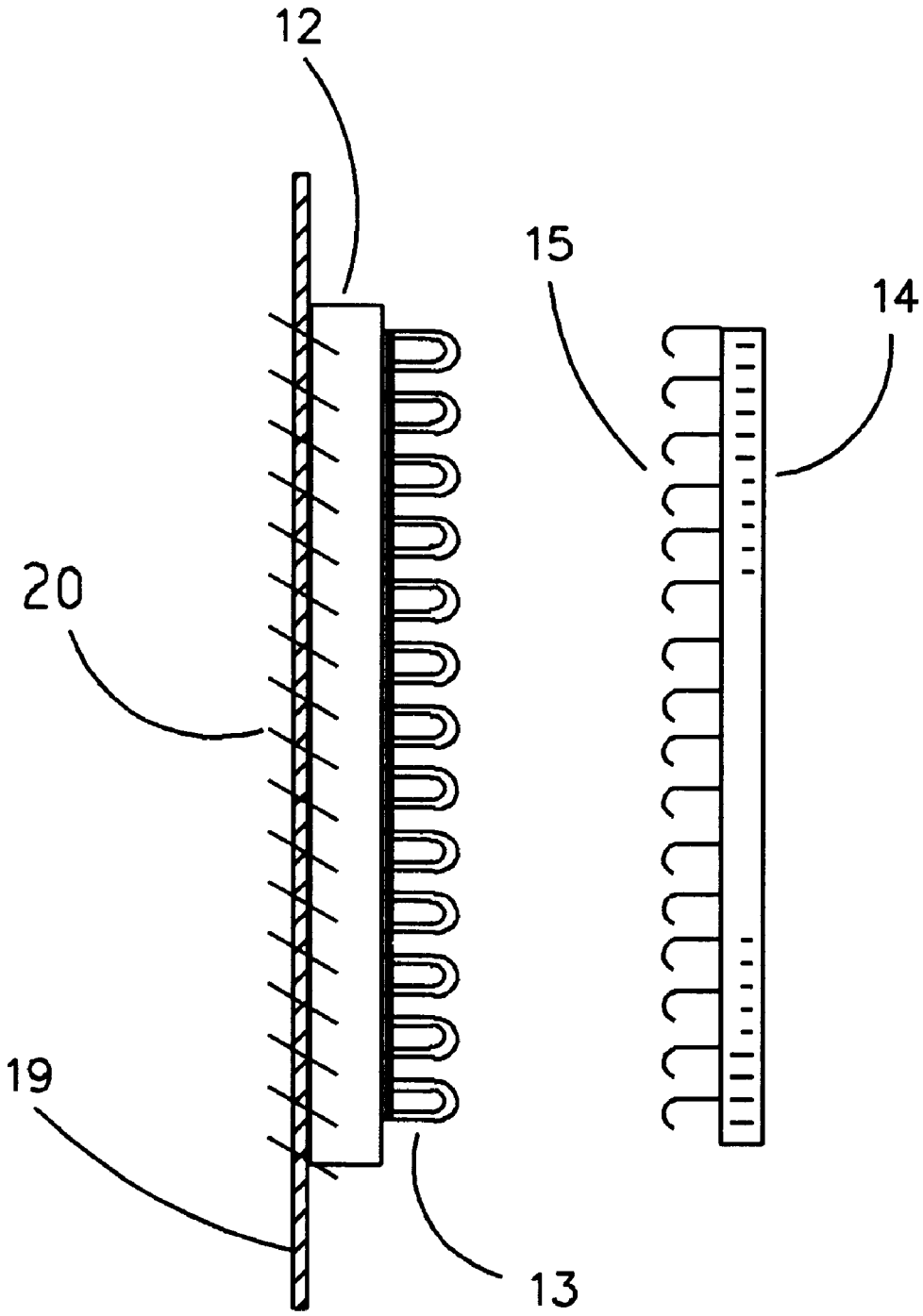
FIG. 5 shows the present invention with the loop part sown on a garment.

FIG. 5 shows an embodiment of the present invention where the loop material 13 is on a sheet of backing material 12 which is sewn onto a garment 19 with threaded stitches 20. The backing material can be cloth, synthetic, thin plastic, or any other flexible or semi-flexible material. The hook material 15 is attached to the backside of a rigid or semi-rigid nametag or insignia 14. To use the invention, the nametag or insignia 14 is pressed onto the loop surface 13. To remove the nametag or insignia, it can be simply pulled away and either stored until again needed or put on another garment. The action of the hook material and loop material is similar to that of material sold under the registered trademark VELCRO and well known in the art.

The method of the present invention allows a person to display a nametag or rank or ribbon or other insignia on a uniform without making any pin or post holes in the uniform. The method comprises attaching hooks on the back side of a possibly rigid tag and attaching loops onto the front side of a flexible sheetlike member. The sheetlike member can then be sewn onto a uniform in the correct position. Of course, the stitching makes tiny holes, but there are never the larger pinholes made by posts or pins on conventional nametags or insignia. The hooks can be contained on a layer of synthetic material or cloth, and can be attached to the tag by any convenient method (such as through the use of an adhesive). The flexible sheetlike member can be synthetic or cloth. The hook/loop combination can resemble the product VELCRO. The sheetlike material can optionally have heat sensitive adhesive on its back side so that it can be ironed onto the uniform instead of sewn.

It should be noted that the above examples are merely illustrative of the method and apparatus of the present invention and that many other embodiments and uses are within the scope of the invention.

I claim:

1. A removable nametag and shirt combination comprising:

a garment;

a sheetlike receiving member having an outer surface, said receiving member sewed onto said garment at a position for displaying a name or rank, the outer surface of said receiving member having a plurality of loops facing away from said shirt;

a rigid planar member with first and second sides, said first side containing indicia of name or rank, said second side having an attached layer containing a plurality of hooks;

said planar member being worn on said shirt by pressing the hooks on said second side of said planar member against the loops on said sheetlike receiving member.

2. The removable nametag of claim 1 wherein the sheetlike receiving member is woven synthetic resin material.

3. The removable nametag of claim 1 wherein the sheetlike receiving member is cloth.

4. The removable nametag of claim 1 wherein the rigid planar member is metal.

5. The removable nametag of claim 1 wherein the rigid planar member is plastic.

6. The removable nametag of claim 1 wherein the flexible sheetlike receiving member and the rigid planar member are rectangular.

7. A method of displaying a name or rank on a garment comprising the steps of:

producing a rigid planar nametag or rank insignia with no pins;

attaching a plurality of hooks or loops to a backside of said rigid planar nametag or rank insignia;

attaching a plurality of loops or hooks to a first side of a flexible sheetlike receiving member, said flexible sheetlike receiving member also having a second side;

attaching said flexible sheetlike member to said garment at a position suitable for displaying a name or rank, the front side of said flexible sheetlike member facing away from said garment, and the second side of said flexible sheetlike member facing toward said garment;

coupling said hooks to said loops by pressing the rigid planar nametag or insignia onto said sheetlike member to wear the nametag or insignia;

decoupling said hooks from said loops by pulling the rigid planar nametag or insignia away from said sheetlike member for laundering and ironing said garment.

8. The method of claim 7 wherein said sheetlike member is sewn on said garment.

9. The method of claim 7 wherein said sheetlike member is attached to said garment with adhesive.

10. The method of claim 7 further comprising the steps of:

applying a thin layer of heat sensitive adhesive to said second side of said sheetlike member;

ironing said sheetlike member onto said garment so that said heat sensitive adhesive causes said sheetlike member to become attached to said garment.

* * * * *